US006112636A

United States Patent [19]

Besselink

[11] Patent Number: 6,112,636

[45] Date of Patent: Sep. 5, 2000

[54] GAS-OPERATED PISTOL

[76] Inventor: Bernard Christian Besselink, 31 Switchback Road, Churchill, VIC 3842, Australia

[21] Appl. No.: 09/180,865

[22] PCT Filed: Mar. 25, 1998

[86] PCT No.: PCT/AU98/00202

§ 371 Date: Nov. 23, 1998

§ 102(e) Date: Nov. 23, 1998

[87] PCT Pub. No.: WO98/43034

PCT Pub. Date: Oct. 1, 1998

[51] Int. Cl.[7] ..... F41A 5/00; F41C 3/00

[52] U.S. Cl. ..... 89/191.01; 89/184; 89/185; 89/194

[58] Field of Search ..... 42/40; 89/191.01, 89/180, 181, 184, 185, 194, 195, 196

[56] References Cited

U.S. PATENT DOCUMENTS

| | | | |
|---|---|---|---|
| 889,279 | 6/1908 | Warnant | 89/196 |
| 970,307 | 9/1910 | Clement | 89/196 |
| 1,023,966 | 4/1912 | Rosier | 89/196 |
| 4,909,129 | 3/1990 | Reynolds | 89/191.01 |
| 5,581,046 | 12/1996 | Weldle et al. | 89/196 |
| 5,939,657 | 8/1999 | Morgado | 89/33.03 |

*Primary Examiner*—Charles T. Jordan
*Assistant Examiner*—Michelle Thomson

[57] ABSTRACT

A gas-operated pistol which comprises a frame having a handgrip and adapted to receive a magazine. A slide is mounted for alternating longitudinal movement along the frame. A barrel is provided which is able to pivot at its muzzle end and rotate upwards from a locking engagement via locking means with the frame to allow a cartridge to be removed. An actuating means rotates the barrel upwards after the high pressure period has passed. A cylinder is located above the barrel and communicates with the barrel bore via a passage. The action of propellant gases in the cylinder on the piston urges the slide rearwards. This arrangement reduces the effect of felt recoil on the firer when using very powerful cartridges.

5 Claims, 2 Drawing Sheets

GAS-OPERATED PISTOL

TECHNICAL FIELD

This invention relates to self-loading pistols and more particularly to self-loading pistols of the gas-operated type.

Self-loading pistols include semi-automatic pistols and automatic pistols in contrast to other types of pistols which do not self-load such as revolvers. Semi-automatic pistols require discrete trigger operations, and automatic pistols continue to fire while the trigger remains depressed.

Self-loading pistols may be recoil-operated or gas-operated. Recoil-operated pistols receive the energy to operate their loading mechanism from the energy of recoil. Gas-operated pistols receive the energy to operate their loading mechanism from the energy derived from the propellant gas pressure in the barrel.

In recoil-operated pistols, the recoil force drives the slidable superstructure of the pistol rearward on a horizontal platform built into a lower frame to extract the spent cartridge case from the firing chamber and eject it from the pistol. The superstructure is then returned to the forward or battery position by a return spring and is adapted to strip the succeeding round from a magazine and insert it into the firing chamber.

Gas-operated pistols generally employ an expansion chamber beneath the barrel connected to the barrel by a passage. On firing the cartridge, propellant gas is bled via the passage into the chamber and the increase in gas pressure moves a piston rearwards. The rearward movement of the piston actuates the unlocking of the breech block from the barrel. Energy is transferred to the breech block. The breech block is able to slide rearward in the frame to extract the spent cartridge case from the firing chamber and eject it from the pistol. It continues the cycle as described for the recoil-operated pistol.

BACKGROUND ART

Self-loading pistols can be divided into a number of types such as pure blowback, delayed blowback, gas-operated, short-recoil-operated and long-recoil-operated.

With pure blowback pistols, the slidable superstructure consists only of a breech block slide. The slide is not locked to the barrel and the barrel is fixed to the frame. Immediately after firing, the recoil force starts to drive the slide rearwards thus commencing the extraction of the spent cartridge case. Thus, part of the extraction occurs during the high pressure period of the firing cycle. If the slide is too light, the case is extracted too soon and case rupture will result, leading to a failure of the loading cycle and possible injury to the user. As a result, the pure blowback type can only be used with low-powered cartridges since there is a practical limit to the mass of the slide. This type, however, is cheap to make and is quite common.

There are also a number of pure blowback pistols which use a gas retarding arrangement attached to the slide. The arrangement reduces the effect of residual gas pressure on the motion of the breech block slide and buffers the stop of the breech block slide.

One such gas retarding arrangement consists of a piston attached to the slide and a cylinder attached to the frame. The cylinder is connected by a passage to the barrel bore. After firing, a small amount of propellant gas is bled into the cylinder. As the slide recoils, the piston attached to the slide compresses the bled propellant gas, thus producing a retarding force.

With delayed blowback pistols, the slidable superstructure comprises a breech block slide but, as well, it has a delaying mechanism. The delaying mechanism is usually based on leverage in order to magnify the effective recoiling mass of the superstructure for a short period, thus reducing the extent of extraction of the spent cartridge case during the high pressure period of the firing cycle.

With many gas-operated pistols, the slidable superstructure comprises a breech block slide, and the pistol has a gas chamber and piston located beneath the barrel. The slide is locked to the barrel and the barrel is fixed to the frame. The gas chamber is connected by a passage to the barrel bore. After firing, the projectile travels along the barrel and passes the entrance to the passage and gas is bled into the chamber. The gas pressure drives the piston to actuate an unlocking mechanism after the high pressure period has passed. After unlocking, the breech block slide starts its rearward motion and begins extraction of the spent cartridge case using the energy provided by the piston and the residual gas pressure in the barrel. After extraction, the spent cartridge case is ejected. The slide continues until full travel is reached. The cartridge case does not move while the bullet is in the barrel. Since the case is not able to move relative to the barrel until the slide is disengaged from the barrel and the operation is not dependent on the mass of the slidable superstructure, this type is used for very powerful cartridges.

With short-recoil-operated pistols, the slidable superstructure consists of a barrel and a breech block slide. Prior to the firing of the cartridge, the barrel is engaged to the breech block slide by a locking means. After firing, the recoil force drives both the slide and barrel rearwards, but since they are in engagement, the extraction of the case has not started. After the high pressure period has passed, an actuator begins to disengage the barrel from the slide. The barrel travels a short distance before coming to rest forward of the magazine, hence short-recoil, and is completely disengaged from the slide. The breech block slide continues and begins extraction of the spent cartridge case using its kinetic energy and the residual gas pressure in the barrel. After extraction, the spent cartridge case is ejected. The slide continues until full travel is reached. The cartridge case, therefore, does not move while the bullet is in the barrel. Since the case is not able to move relative to the barrel until the barrel is disengaged from the slide, this type is used for relatively powerful cartridges. However, revolvers are generally needed for the most powerful pistol cartridges; since again, there is a practical limit to the mass of the barrel and slide on short-recoil-operated pistols.

A limitation in self-loading pistols of current design is the high level of felt recoil when using very powerful cartridges.

Cartridges of the same type with the same bullet mass, propellant and propellant loading must produce the same recoil as the laws of physics demand. This recoil force acts along the axis of the barrel. However, the axis of the barrel of a self-loading pistol is located above the pivot point in the firer's wrist and usually above the pivot point in the firer's shoulder. On firing a self-loading pistol, a moment is produced about these points. These moments produce a rotation of the firer's hand and an upward movement of the firer's arm. In addition, the slidable superstructure of a self-loading pistol moves backwards on the frame after firing and causes a shift in the centre of mass of the pistol. The final effect which occurs is the force from stopping the slidable superstructure at the end of its rearward travel. The felt recoil is the combination of the effects described above.

High felt recoil affects the first round hit probability because the firer may flinch on firing in anticipation of the recoil. High felt recoil also reduces second round hit probability as it takes the firer longer to readjust his aim for the second shot.

The distance of the barrel of a self-loading pistol from the pivot point in the firer's wrist is a result of a number of factors.

Firstly, in most self-loading pistols the magazine containing the rounds of ammunition is located in the hand grip. Since the magazine must present a round at a certain angle for stripping, the angle of the grip to the frame is determined by the angle of the magazine to the barrel bore axis. The dimensions of the grip are also determined by the magazine. The angle of the grip determines how far the wrist is able to rotate the hand of the firer forward and downward. The further the hand of the firer is rotated forward and downward, the shorter the distance between the barrel axis and the pivot in the firer's wrist.

Secondly, the size of the locking arrangements will determine how far the barrel must be positioned above the top of the magazine. The more bulky the locking arrangements, the higher the barrel must be above the top of the magazine and therefore the pivot point in the firer's wrist.

The advantage of having a sharper handgrip angle is evident in target pistols. Target pistols tend to have an handgrip angle of about 60 degrees as compared to a commercial self-loading pistol with an angle of about 75 degrees.

In contrast to the prior art self-loading pistols, it is the object of the present invention to provide a gas-operated pistol which reduces felt recoil by having a barrel mounted forward of the magazine with a barrel axis below the lips of the magazine located in the grip.

DISCLOSURE OF INVENTION

Essentially a self-loading pistol of the gas-operated type according to the invention comprises a frame having a handgrip adapted to be grasped by the user and a receiver in the frame adapted to releasably receive a magazine. The magazine is adapted to be inserted into the receiver. A slide member is slidably mounted for alternating longitudinal movement in the frame between a forward battery position and a rearward fully retracted position. The slide member carries a feed block means which is adapted to extract a case from the firing chamber during its rearward movement and strip the succeeding round from the magazine during its forward movement. Neither the slide member nor the feed block means carries any mechanism for firing a cartridge. A barrel is provided which is located forward of the magazine with the axis of the barrel bore when in the locked position below the lips of the magazine. The barrel is adapted to rotate upwards so that at its highest position the opening to the firing chamber is uncovered and available for a case to be extracted. The rear portion of the barrel is provided with a lug or lugs to positively engage a recess or recesses in the frame during the high pressure period of the firing cycle. The muzzle end of the barrel is rotatably mounted to the frame about a transverse axis. The frame is provided with a breech closure means which covers the breech opening of the firing chamber when the barrel is in its lowest and locked position and prevents rearward movement of the cartridge case during the high pressure period. The frame carries a firing means to fire the cartridge after pulling the trigger. An actuating means is provided which rotates the barrel from its lowest and locked position to its highest position after the high pressure period has passed. The actuating means rotates the barrel to its lowest and locked position during the return of the slide member to the battery position. A force means is provided on the forward end of the barrel. The force means communicates with the barrel bore via a passage or passages such that propellant gases act to operate the actuating means. A return spring urges the slide means to return to the battery positions.

When a pistol according to the invention is fired, the projectile moves forward along the barrel bore. Prior to exiting the barrel, it passes and uncovers the entrance or entrances to the passage or passages communicating with the barrel bore. As a result, some of the propellant gases provide energy for the force means. The force means acts on the slide means and the actuating means. The actuating means starts to rotate the barrel upwards from its lowest position. The slide means moves rearwards to begin the extraction and loading cycle.

The barrel rotation continues under the influence of the actuating means until it is stopped and held at its highest position. At the highest position of the barrel, the breech opening is clear of the breech closure means and the cartridge case is able to be extracted. The feed block means extracts the cartridge case as the feed block means moves rearwards under the influence of the slide means. The feed block means continues rearward to eject the spent cartridge case from the pistol. The feed block means continues until it reaches its rearward fully retracted position.

The return spring urges the slide means forward. This action urges the feed block means forward. As the feed block reaches the magazine, the succeeding round is stripped from the magazine in the usual manner and inserted into the firing chamber. The barrel is urged downwards from its highest position under the action of the actuating means. In its lowest position, the barrel is engaged with the frame via the locking means and the opening of the firing chamber is closed off by the breech closure means.

The number of passages provided for the force means depends on the force required. A passage may be a circular hole, a slot or other orifice.

The type of force means may be gas pressure or gas impulse.

As already mentioned, the prior art use of gas-operated arrangements in pistols is commonly known. However, persons skilled in the art have never utilized gas operation to rotate a barrel upwards in order to make the round available for extraction.

The advantage of the present invention with respect to other gas-operated self-loading pistols is that the present invention provides a better solution to the problem of strong felt recoil when using relatively powerful ammunition.

It should be noted that the felt recoil for a pistol according to the invention is less than that of a conventional self-loading pistol of the same power. This is a result of the low barrel position and the high hand position possible which produces a smaller moment relative to the shooter's hand than conventional pistols. Furthermore, the mass of rearward moving parts is less since they are able to be of a lighter construction as they do not need to withstand barrel pressures and do not carry a firing mechanism. The rearward moving parts carry no barrel locking elements and are only required for extraction and loading.

The first preferred embodiment of the invention comprises a gas-operated self-loading pistol in which the locking means comprises a locking lug located on the underside of the barrel and a matching locking recess located in the frame under the barrel. The slide means carries the actuating means and the feed block means. The actuating means comprises a protuberance located on one side of the slide means on its inside surface towards the muzzle end of the pistol. The protuberance is adapted to engage a cam slot formed in the side of the barrel. A cam slot comprises a forward inclined section which acts to rotate the barrel in the vertical plane and a rear section which is aligned parallel to the barrel axis. As a result, the barrel is able to be rotated in the vertical plane and maintained in its highest position during the extraction, ejection and loading sections of the firing cycle. The feed block means is carried at the rear end of the slide means. The feed block means is slidably mounted to the slide means. The rear end of the feed block means carries a feed block locking means which is in locking engagement with the frame while the barrel is rotating upwards to prevent rearward movement of the feed block means until the barrel is in its highest position. A firing means of the double action type is provided which comprises a firing pin, a hammer, a hammer connecting rod substantially parallel to the barrel axis, and a striker means mounted under the barrel. The force means comprises a piston and cylinder mounted on the top of the front end of the barrel where the rear end of the piston is connection with the slide member.

It should be clear to a person skilled in the art that there are other conventional means available to produce the required rotation of the barrel as described above and not require a change to the novel features of the invention. The force means may also use gas impulse jets to impinge on the component carrying the actuating means.

It should be clear that a self-loading pistol according to the invention provides a novel means for reducing felt recoil to a firer.

The dimensioning of all components of a firearm according to the invention will depend on the materials used and would be clear to a person skilled in the art. Although not all the alternative arrangements are shown or specifically described, all of them must be considered to be within the scope of the invention.

BRIEF DESCRIPTION OF DRAWINGS

The construction and operation of preferred embodiments of the subject invention will be more fully understood from a reading of the following detailed description as illustrated by the accompanying drawings. The embodiments shown in the drawings are only given by way of example and in no way limit the scope of the present invention. The drawings are described as follows.

BEST MODE FOR CARRYING OUT THE INVENTION

Figure 1:
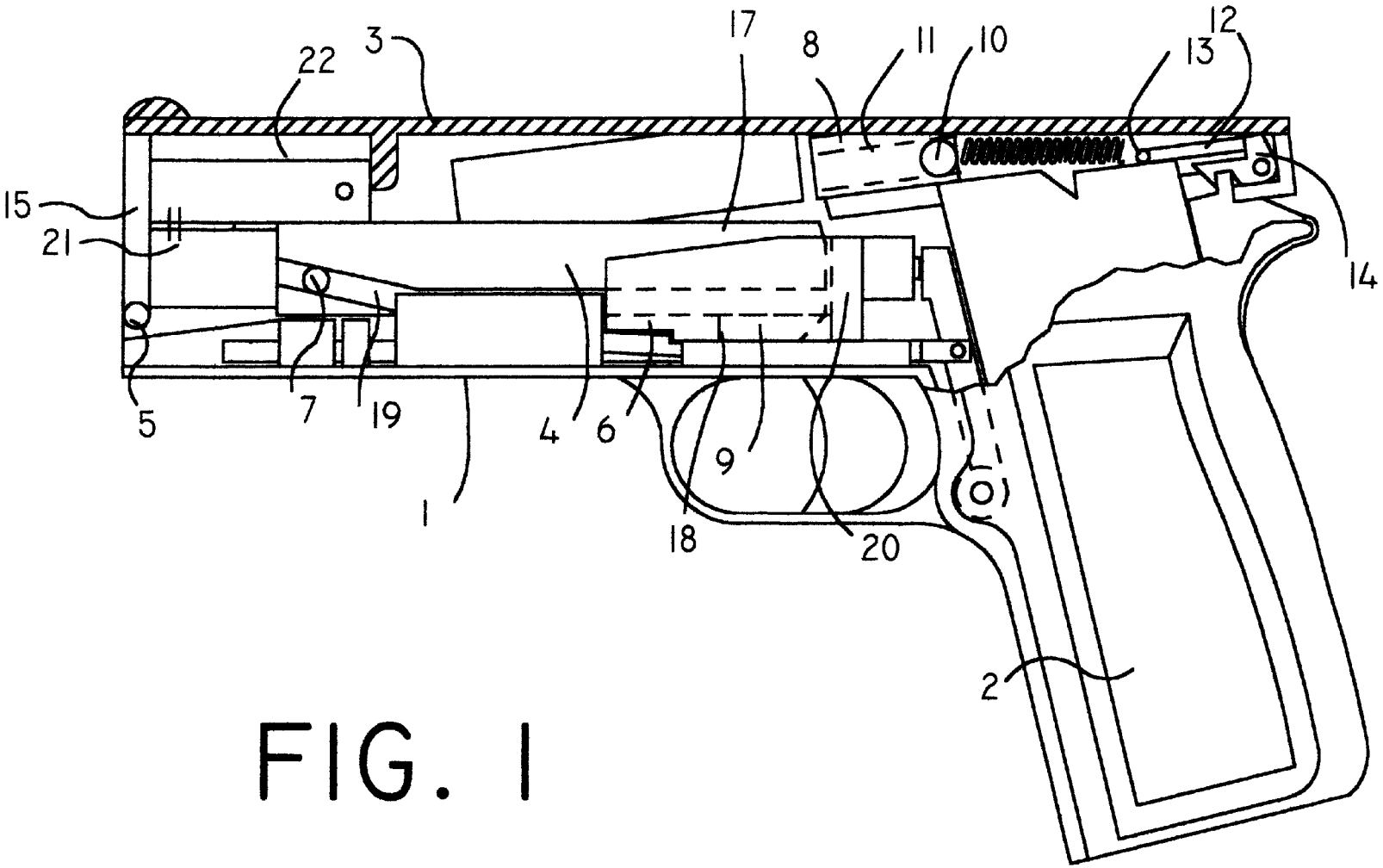
FIG. 1 represents a side elevation of a pistol according to the invention, with a longitudinal cross-sectional view of the forward part of the pistol, and with the slide means in the battery position and the trigger not depressed.
Figure 2:
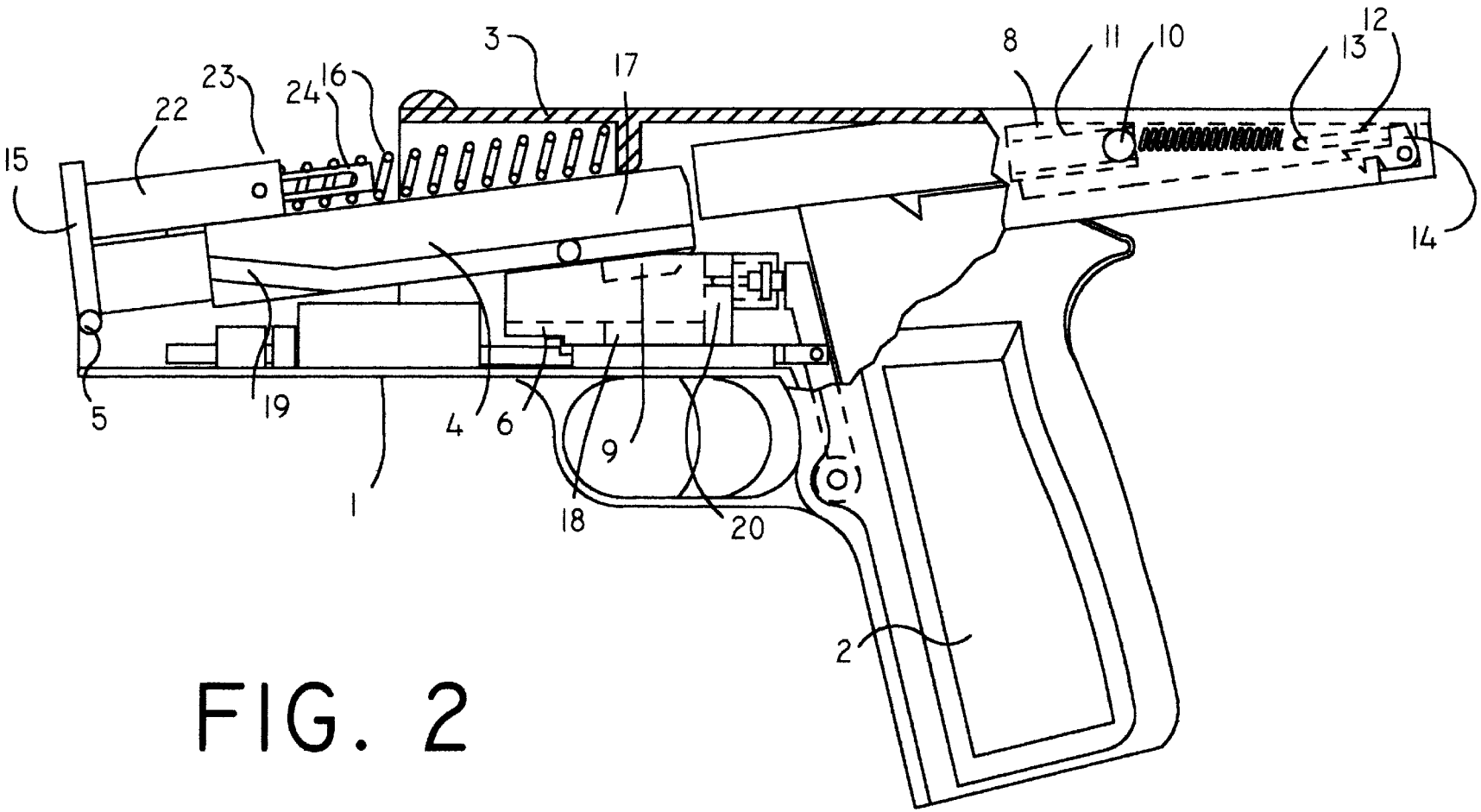
FIG. 2 represents a side elevation of a pistol according to the invention, with a longitudinal cross-sectional view of the forward part of the pistol, and with the slide means in the fully retracted position and the barrel in the uppermost position.

As shown in FIGS. 1 and 2, the illustrated self-loading pistol embodying the subject invention is of the gas-operated type using a unique method of locking whereby the barrel rotates upwards to uncover the mouth of the breech chamber. The illustrated gas-operated pistol has the overall configuration of conventional pistols.

The gas-operated pistol illustrated in FIGS. 1 and 2 comprises a frame 1 having a handgrip 2 including a receiver adapted to receive a magazine. A barrel 4 has a front barrel pivot 5 at its forward end adapted to allow rotation about a transverse axis below the barrel. The rear of the barrel 4 is cradled in the locking block 6 when in the firing position. A slide means 3 is mounted for alternating longitudinal movement in frame 1 in an inclined manner. The slide means 3 is mounted above and partially surrounding the barrel 4. The slide means 3 has protuberance in the form of a stud 7 located to one side of barrel 4 and located towards the forward end of the slide means 3. The slide means 3 carries the feed block means 8 in its rear section. The feed block means 8 has studs 10 either side at its front top end which slide in slots 11 in the slide means 3 on either side. The rear end of the feed block means 8 has a slot 12 through which passes a transverse pin 13 carried by the slide means 3. The rear end of the feed block means 8 also has a feed block locking means 14 which engages the frame 1 and prevents rearward movement of the feed block 8 until the barrel 4 is in the fully upwards position. The front barrel mount 15 is adapted to engage the one end of the return spring 16.

The barrel 4 has a barrel locking lug 9 located substantially below the firing chamber 17. The barrel locking lug 9 and the locking recess 18 comprise the locking means.

As shown in FIGS. 1 and 2, the subject invention differs to conventional pistols in that it has the novel feature of a barrel which rotates upwards for extraction of a cartridge.

The actuating means comprises a stud 7 fixed to inside of the slide means 3 and a cam slot 19 formed in the side of the barrel 4. A cam slot 19 has an inclined section at its forward end which enables the stud 7 to urge the barrel 4 upwards relative to the frame 1 and to rotate the barrel 4. At its rear end, a cam slot 19 has a section which is aligned parallel to the barrel axis and is able to maintain a substantially constant angle of the barrel 4 in its upper position relative to the frame 1.

As FIGS. 1 and 2 show, the subject invention is provided with a helical coil return spring 16 mounted above and axially parallel to the slide member 3.

The trigger mechanism is mounted forward of the magazine.

The general operation of the pistol allows the firing of a round. During the high pressure period after firing, the barrel 4 is locked to the frame 1 via the locking block 6 and the breech closure means 20 attached to the locking block 6 prevents rearward movement of the cartridge case. Before exiting the barrel 4 the projectile passes and uncovers the entrance to the passage 21. Some of the propellant gases pass through the passage 21 to the cylinder 22. The gas force urges the piston 23 and piston rod 24 rearwards. The piston rod 24 is connected to the slide means 3 and so it moves rearwards. Since the stud 7 of the actuating means is mounted on the slide means 3 the stud 7 acts on the inclined section of a cam slot 19 to begin rotation of the barrel 4 upwards. The rotation of barrel 4 begins after the projectile has left the barrel 4. The feed block means 8 is unable to move rearwards at this stage as it is locked to the frame 1 by feed block locking means 14. As the slide means 3 continues to move rearwards, the barrel 4 continues to rotate upwards. When the stud 7 has reached the transition point from the inclined section to the rear section of the cam slot 19, the barrel 4 is at its highest position. At this point, the barrel 4 has completely disengaged from the locking block 6 and the frame 1 and the breech opening is in front of the face of the feed block means 8. The slide means 3 continues rearward and the pin 13 actuates the feed block locking means 14 to unlock the feed block means 7 from its engagement with the frame 1. The feed block means 8 extracts the spent cartridge case and ejects it from the pistol. The slide means 3 continues until it obtains its rearward fully retracted position.

The return spring 16 urges the slide means 3 and feed block means 8 forward. As the feed block means 8 reaches the magazine, the succeeding round is stripped from the magazine in the usual manner. The round is inserted into the firing chamber 17 while the barrel 4 is in its highest position. When the cartridge is completely installed in the firing chamber 17 the feed block locking means 14 engages the feed block means 8 to the frame 1. As the slide means 3 continues forward the stud 7 enters the inclined section of the cam slot 19 and the barrel 4 is urged downward from its highest position. The barrel 4 is rotated downwards so that the barrel locking lug 9 engages the locking recess 6 and the breech opening is in front of the breech closure means 20. When the stud 7 has reached its most forward position in the cam slot 19 the locking alignment is complete and the slide member 3 stops its forward motion. The barrel 4 and slide means 3 have completed the operational cycle and returned to the battery position and the weapon is ready for firing.

The invention is not intended to be limited to the specific form of the embodiment shown, which is presented for illustrative purposes only. Rather, it contemplates all of the variations and modifications coming within the scope of the claims.

What is claimed is:

1. A self-loading pistol of the gas-operated type comprising a frame having a handgrip adapted to be grasped by the user;

a trigger mounted in said frame;

a firing means carried by said frame which fires (the) a cartridge comprising a cartridge case after pulling the trigger producing a high pressure period;

a receiver in said frame adapted to releasably receive a magazine;

a magazine adapted to be inserted into said receiver where said magazine has lips to retain the cartridges;

a slide means slidably mounted for alternating longitudinal movement along said frame between a forward battery position and a rearward fully retracted position (where said slide means);

a barrel having a muzzle, a barrel bore and a firing chamber where said firing chamber has a breech opening and where said barrel is located forward of the said magazine with the axis of the barrel bore when in the locked position below the lips of the said magazine and adapted to rotate upwards so that at its highest position the opening to the firing chamber is uncovered and available for a case to be extracted;

a feed block means which is carried by said slide means and is adapted to extract a case from the firing chamber during its rearward movement and is adapted to strip the succeeding round from the said magazine during its forward movement;

(a barrel located forward of the said magazine with the axis of the barrel bore when in the locked position below the lips of the said magazine and adapted to rotate upwards so that at its highest position the opening to the firing chamber is uncovered and available for a case to be extracted;)

a breech closure means which is adapted to cover the breech opening of the firing chamber when the barrel is in its lowest and locked position and prevents rearward movement of the cartridge case during the high pressure period;

a locking means which positively engages said barrel and said frame during the high pressure period of the firing cycle;

an actuating means which acts to rotate the barrel from its lowest and locked position to its highest position after the high pressure period has passed and to rotate the barrel to its lowest and locked position during the return of the slide member to the battery position;

a force means located at the forward end of the barrel which communicates with the barrel bore via a passage or passages such that propellant gases act to operate the actuating means; and a return spring which urges the said slide means to return to the battery position.

2. A self-loading pistol according to claim 1 wherein said locking means comprises a locking lug located on the underside of the said barrel and a matching locking recess located in the said frame under the barrel.

3. A self-loading pistol according to claim 1 wherein said actuating means comprises a protuberance located on one side of the said slide means on its inside surface towards the muzzle end of the pistol where the protuberance is adapted to engage a cam slot formed in the side of the said barrel and where said cam slot comprises a forward inclined section which acts to rotate the said barrel in the vertical plane and a rear section which is aligned parallel to the barrel axis.

4. A self-loading pistol according to claim 1 wherein the said feed block means is carried at the rear end of the said slide means and is slidably mounted to the slide means where the rear end of the said feed block means carries a feed block locking means which is in locking engagement with the frame while the barrel is rotating upwards to prevent rearward movement of the said feed block means until the barrel is in its highest position.

5. A self-loading pistol according to claim 1 wherein the said force means comprises a piston and cylinder mounted on the top of the front end of the said barrel where the rear end of the piston is in connection with the said slide means.

* * * * *